US011828464B1

(12) United States Patent
Anand

(10) Patent No.: US 11,828,464 B1
(45) Date of Patent: Nov. 28, 2023

(54) LIGHTER WITH TIMER

(71) Applicant: Aditya P. Anand, Ashland, MA (US)

(72) Inventor: Aditya P. Anand, Ashland, MA (US)

( * ) Notice: Subject to any disclaimer, the term of this patent is extended or adjusted under 35 U.S.C. 154(b) by 880 days.

(21) Appl. No.: 16/743,719

(22) Filed: Jan. 15, 2020

Related U.S. Application Data

(60) Provisional application No. 62/792,694, filed on Jan. 15, 2019.

(51) Int. Cl.
*F23Q 2/36* (2006.01)
*F23Q 2/32* (2006.01)
*F23Q 7/16* (2006.01)

(52) U.S. Cl.
CPC ..... *F23Q 2/325* (2013.01); *F23Q 2/36* (2013.01); *F23Q 7/16* (2013.01)

(58) Field of Classification Search
CPC ..... F23Q 2/325; F23Q 2/36; F23Q 7/16
See application file for complete search history.

(56) References Cited

U.S. PATENT DOCUMENTS

| | | | | |
|---|---|---|---|---|
| 3,735,099 | A | 5/1973 | Herr | |
| 3,744,953 | A | 7/1973 | Herr | |
| 4,111,638 | A | 9/1978 | Ostberg | |
| 4,209,977 | A | 7/1980 | Yoshinaga | |
| 4,311,448 | A | 1/1982 | Strauss | |
| 4,368,030 | A | 1/1983 | Benedetti | |
| D303,721 | S | 9/1989 | Yu | |
| 5,228,848 | A | 7/1993 | Kim | |
| 6,196,833 | B1 * | 3/2001 | Ho | F23D 14/38 431/153 |
| 6,693,850 | B2 | 2/2004 | Mulaw | |
| 9,295,285 | B2 | 3/2016 | Glazer | |
| 2008/0160463 | A1 * | 7/2008 | Biriki | F23Q 2/287 431/86 |
| 2009/0098494 | A1 * | 4/2009 | Aronson, II | F23D 14/28 431/153 |

* cited by examiner

*Primary Examiner* — Alfred Basichas
(74) *Attorney, Agent, or Firm* — CRAMER PATENT & DESIGN, PLLC; Aaron R. Cramer

(57) ABSTRACT

A hand-held torch-style lighter is in electrical communication with a timer capable of alerting a user to the length of time a lighter has been on. A waring alarm will activate if the lighter has been active for more than two minutes (2 min.).

1 Claim, 5 Drawing Sheets

LIGHTER WITH TIMER

RELATED APPLICATIONS

The present invention is a Continuation of and claims the benefit of U.S. Application No. 62/792,694, filed Jan. 15, 2019, the entire disclosures of which are incorporated herein by reference.

FIELD OF THE INVENTION

The present invention relates to a lighter that incorporates a timing device.

BACKGROUND OF THE INVENTION

In today's society, the benefits of medical marijuana (*Cannabis sativa, C. indica, C. ruderalis*) and its constituents, such as delta-8-tetrahydrocannabinol (THC), cannabidiol (CBD), and cannabinol (CBN) among other psychoactive and psychotropic chemicals, plays a huge role in pain management, reduction of nausea, lessening or eradiction of muscle spasms, among other positive uses. The recognition and acknowledgement of the positive effects of marijuana for the above purposes has been championed by many in the medical field. Many countries have begun or completed the process of de-regulating the use of marijuana for medicine. Many states in the United States of America have done the same. Recently there has been a push to de-regulate the recreational use of marijuana in that the adverse side effects are minor when compared to other commonly used recreational chemical s and drugs, such as alcohol or nicotine.

The usage of cannabis concentrates as a legal recreational drug or for prescribed medical usage is growing in popularity every day. Many people turn to these wax-based marijuana products to treat disease symptoms and pain which are not sufficiently addressed by edibles or regular smoked or vaporized cannabis. The most popular method of wax usage is that of heating the product and ingesting the resultant vapors preferably in an "oil rig" which uses a quartz or titanium nail that is heated by a separate butane torch. However, the heating cycle is somewhat critical not only to ensure that it is properly heated and cooled before use, but also not overheated to avoid damage.

Many people resort to the use of a stopwatch or other timing method to facilitate such use, but such methods require fumbling with another piece of equipment in addition to the oil rig and torch, along with the fact that a timing device is not always handy. Accordingly, there exists a need for a means by which heating and cooling originating from the use of a butane torch can be easily timed to address this need. The use of the lighter with a timer provides for enhanced utilization of a butane torch for smoking cannabis products in a manner which is not only quick, easy, and effective, but controlled and safe as well.

BRIEF SUMMARY OF THE INVENTION

The principles of the present invention provide for a lighter, comprises a timing device in electrical communication with a power source and an igniter. The timing device marks when a trigger is depressed which is in mechanical communication with the igniter. The trigger is depressed resulting in commencing the timing device and actuating the igniter to produce a flame. The device also comprises a display in electrical communication with the timing device and the trigger. The display provides how long it has been since the trigger has been depressed or released, depending on the current state of the trigger. The device also comprises a handle enabling a user to grasp a lighter and a barrel. The barrel is an integral part of the handle and extends away from the handle at an angle and a fuel introduced into a reservoir. The reservoir is in environmental communication with the igniter. The device also comprises a fill port provided to fill the reservoir with fuel, a battery compartment cover located on a rear lower portion of the handle, a burner assembly which is located inside of the barrel that is utilized with one or more fuels and a battery which provides continuous power to a main controller.

An extended activation of the reset switch may deactivate the display while releasing the trigger may reset the timing device and commence another timing cycle. Commencing another timing cycle allows for the lighter to have both heating and cooling cycles. The trigger may be located at a junction point between the handle and the barrel at an underside thereof. The timing device may be a sequential counting device that counts in fractions of seconds until a reset of the timing device occurs. The timing device may be the sequential counting device that counts in fractions of seconds until the trigger is released. The reset may be achieved by a reset switch located at an upper part of the handle or the barrel and is a spring-loaded push switch.

An extended activation of the reset switch may deactivate the display. A subsequent depression of the trigger may restart the timing device. The sequential counting of the timing device may be electrically communicated to a display. The display may be mounted on the handle or the barrel adjacent to the trigger. The handle may have an additional grip. The handle may be without the additional grip. The handle may be made of leather while the barrel may be hollow and provides shaping and concentration of an ignited fuel to produce the flame. The handle may be in the range of six to eight inches in height while the lighter may be disposed on the handle and includes the flame strength adjuster. The flame strength adjuster may be a dial that switches between a plurality of settings that directly correspond to a length of the flame that exits the barrel. The lighter may be a butane torch.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
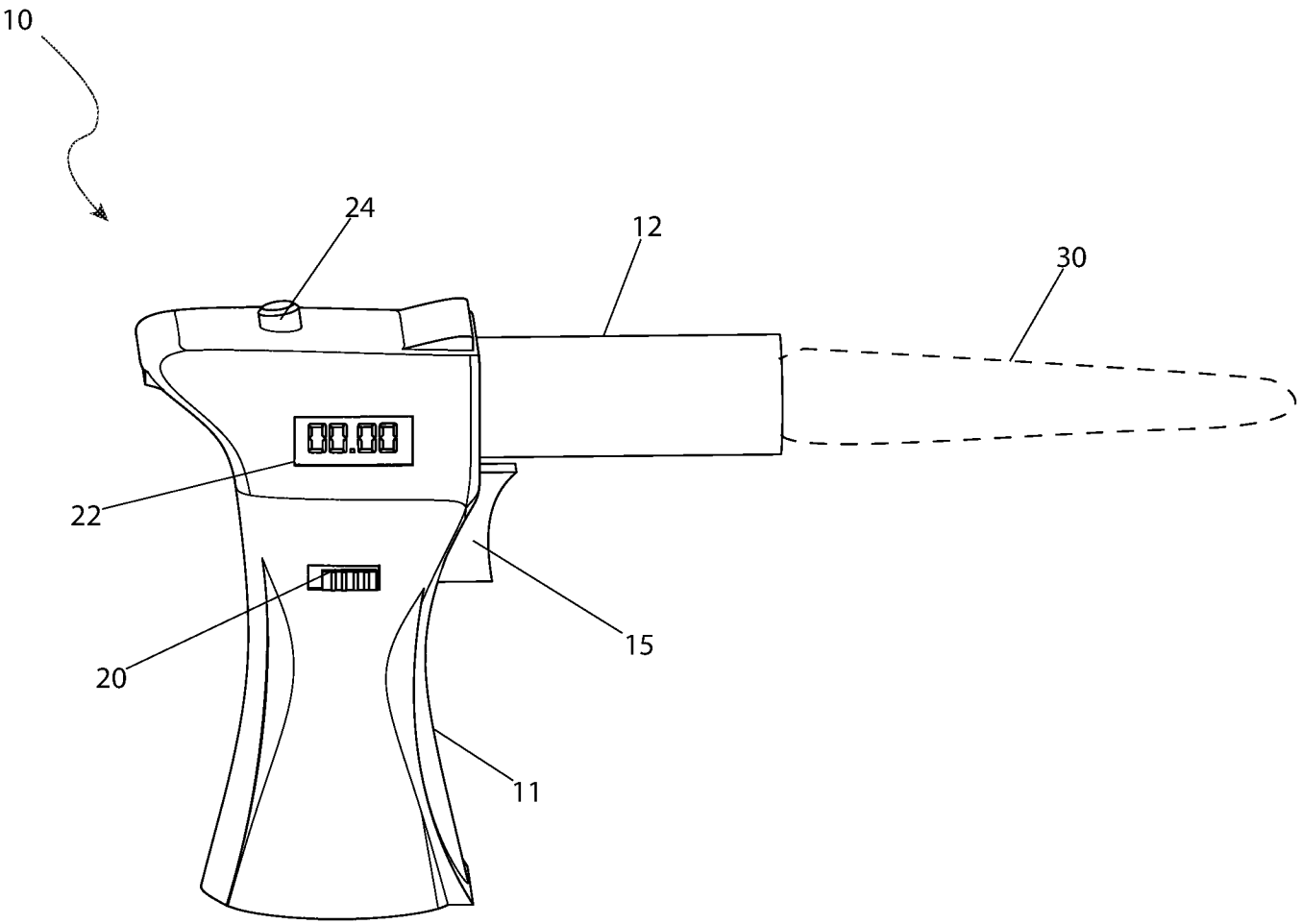
FIG. 1 is a side elevation view of a lighter 10 incorporating a timing device, according to the preferred embodiment of the present invention.

10 lighter
11 handle

12 barrel
15 trigger
20 flame strength adjuster
22 display
24 reset switch
30 flame
35 battery compartment cover
40 burner assembly
45 battery bank
50 main controller
55 gas control valve
60 piezo electric igniter

DESCRIPTION OF THE INVENTION

The best mode for carrying out the invention is presented in terms of its preferred embodiment, herein depicted within FIG. 1. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

The present invention refers to a lighter 10 that incorporates a timing device (not shown) that is in electrical communication with the power source (not shown) and igniter (not shown). The timing device provides a means to mark the period of time beginning with the depression of a trigger 15 that is in mechanical communication with the igniter. Depression of the trigger 15 also results in commencing the timing device and actuating the igniter to produce a flame 30. Releasing of the trigger 15 may also reset the timing device and commence another timing cycle. Such a feature allows for the lighter 10 both heating and cooling cycles. A display 22 is in electrical communication with the timing device and trigger that can be viewed by the user of the lighter 10. Hence, the display 22 provides a visual cue as to how long it has been since the trigger 15 has been depressed or released, depending on the current state of said trigger 15.

The lighter 10 is fashioned as a butane torch or other device that utilizes a fuel and a power source to provide a flame 30. The lighter 10 generally comprises a handle 11 capable of enabling a user to grasp the lighter 10, and a barrel 12. The fuel can be anything that enables the igniter to produce the flame 30 and the power source can be anything that provides power to the electronic features of the lighter 10. The fuel is capable of being introduced into a reservoir (not shown) that resides within the lighter 10. The reservoir is in environmental communication with the igniter. The handle 11 is preferably six to eight inches (6-8 in.) in height and may or may not have an additional grip or bonded the exterior, such as leather. The barrel 12 is preferably an integral part of the handle 11 and extends away from the handle 11 at an angle. The barrel 12 is essentially hollow and provides the shaping and concentration of the ignited fuel to produce the flame 30.

The trigger 15 is located typically at the junction point between the handle 11 and barrel 12 and located at an underside thereof. The trigger 15 is configured to enable a user the ability to depress it such that internally within the lighter 10, there is a linkage that actuates an igniter of any style to combust the fuel to produce the flame 30. As aforementioned, the trigger 15 is also in electrical communication with the timing device. The timing device is a sequential counting device that counts in fractions of seconds until a reset of the timing device occurs or the trigger 15 is released. The reset is preferably achieved by a reset switch 24 located at an upper part of the handle 11 or barrel 12 and is a spring-loaded push switch. When said trigger 15 is released, the timing cycle is reset and another timing cycle is immediately started, to account for heating and cooling cycles as described above. A subsequent depression of the trigger 15 restarts the timing device. The sequential counting of the timing device is electrically communicated to a display 22. The display 22 is preferably mounted on the handle 11 or barrel 12 adjacent to the trigger 15. Also present on the lighter 10, preferably on the handle 11, is a flame strength adjuster 20, typically embodied as a dial that can switch between two (2) or more settings. The flame strength settings directly correspond to the length of the flame 30 that exits the barrel 12. A fill port can be provided to fill the reservoir with fuel when empty.

Figure 2:
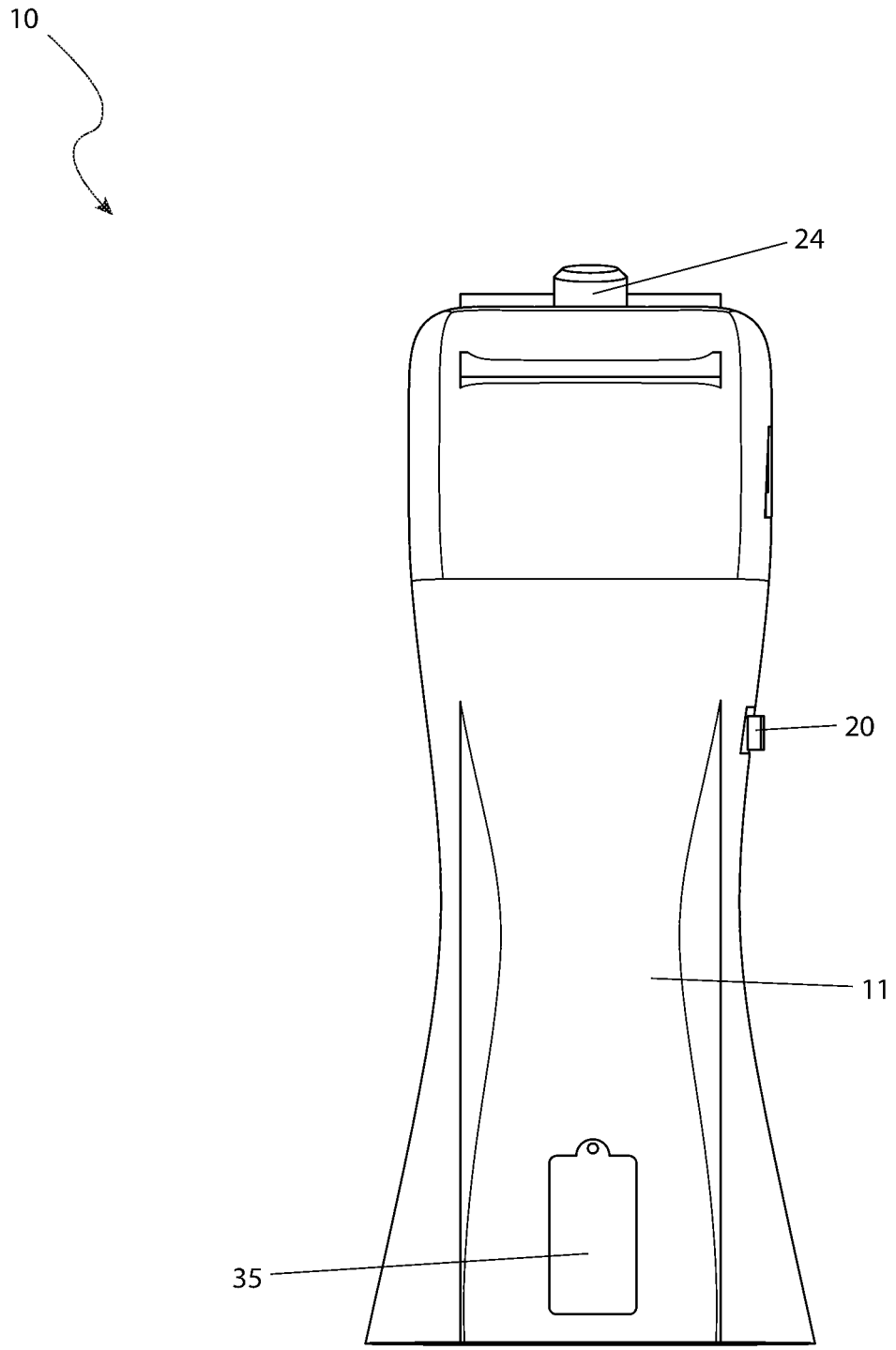
FIG. 2 is a rear view of a lighter 10 incorporating a timing device, according to the preferred embodiment of the present invention.

Referring next to FIG. 2, a rear view of a lighter 10 incorporating a timing device, according to the preferred embodiment of the present invention is disclosed. Said view discloses a battery compartment cover 35 located on the rear lower portion of the handle 11, while the flame strength adjuster 20 remains visible on the right.

Figure 3:
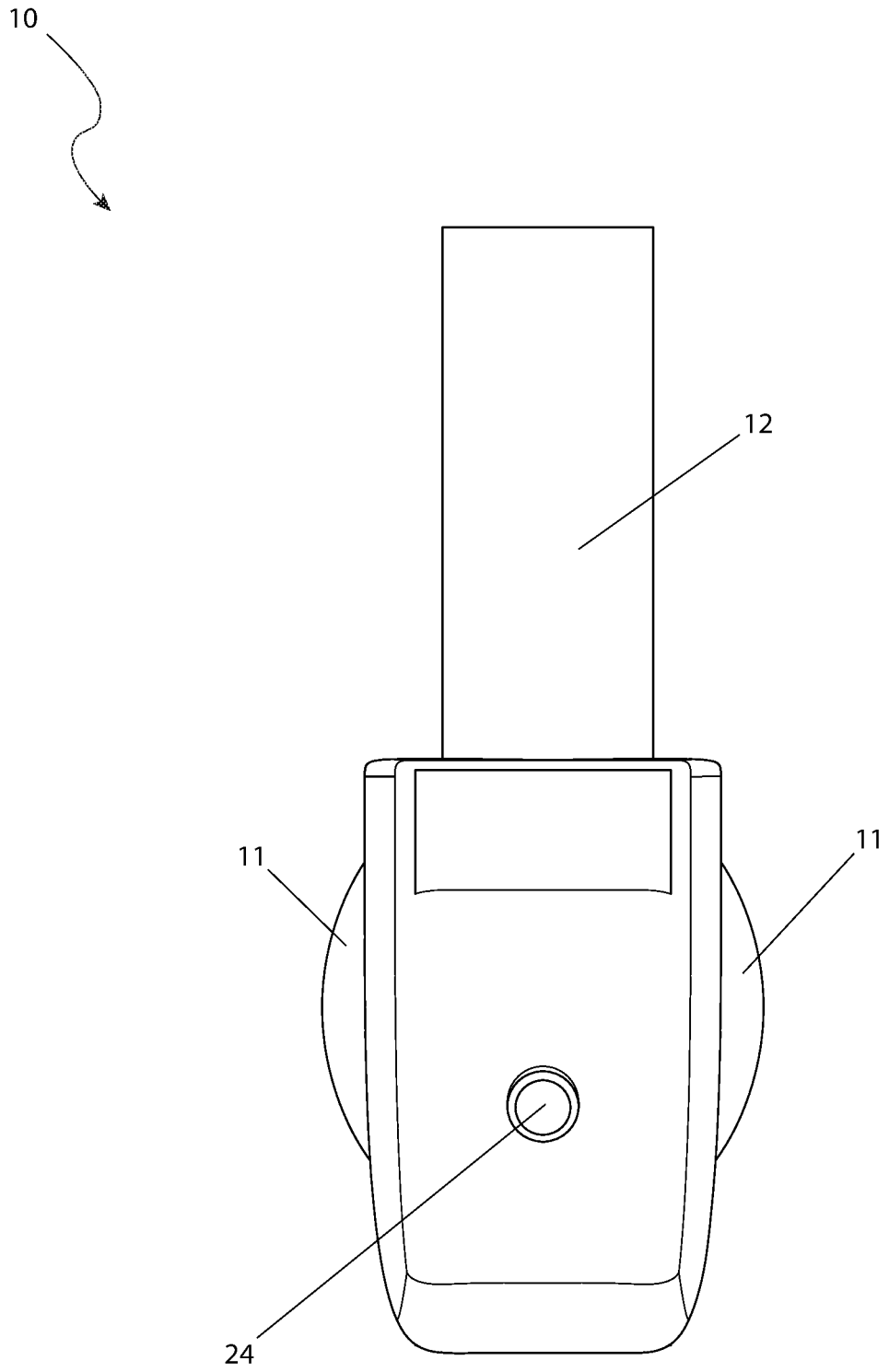
FIG. 3, is a top view of a lighter 10 incorporating a timing device, according to the preferred embodiment of the present invention.

Referring now to FIG. 3, a top view of a lighter 10 incorporating a timing device, according to the preferred embodiment of the present invention is depicted. This view discloses the flame strength adjuster 20 and the reset switch 24 on the handle 11 portion of the a lighter 10 incorporating a timing device. The barrel 12 is shown in an in-line, linear manner to the handle 11.

Figure 4:
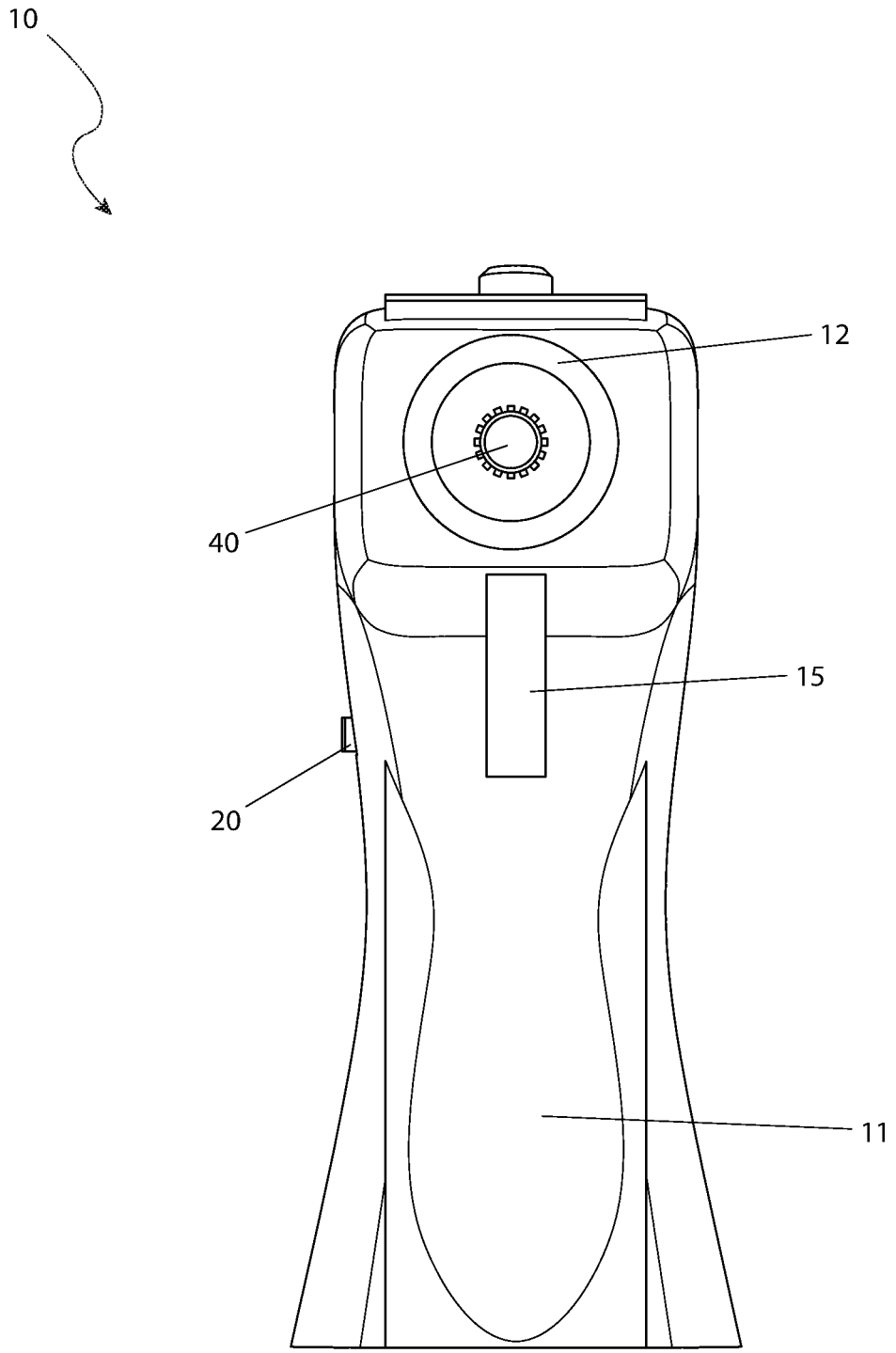
FIG. 4 is a front view of a lighter 10 incorporating a timing device, according to the preferred embodiment of the present invention; and, FIG. 5 is an electrical block diagram of a lighter 10 incorporating a timing device, according to the preferred embodiment of the present invention.

Referring next to FIG. 4, a front view of a lighter 10 incorporating a timing device, according to the preferred embodiment of the present invention is shown The handle 11 is envisioned to be made of impact resistant plastic. The flame strength adjuster 20 is now visible on the left-hand side of the handle 11. The trigger 15 is centrally located at the top of the handle 11. A burner assembly 40 is located inside of the barrel 12 and is suitable for use with fuels such as butane, naphtha, or the like.

Figure 5:
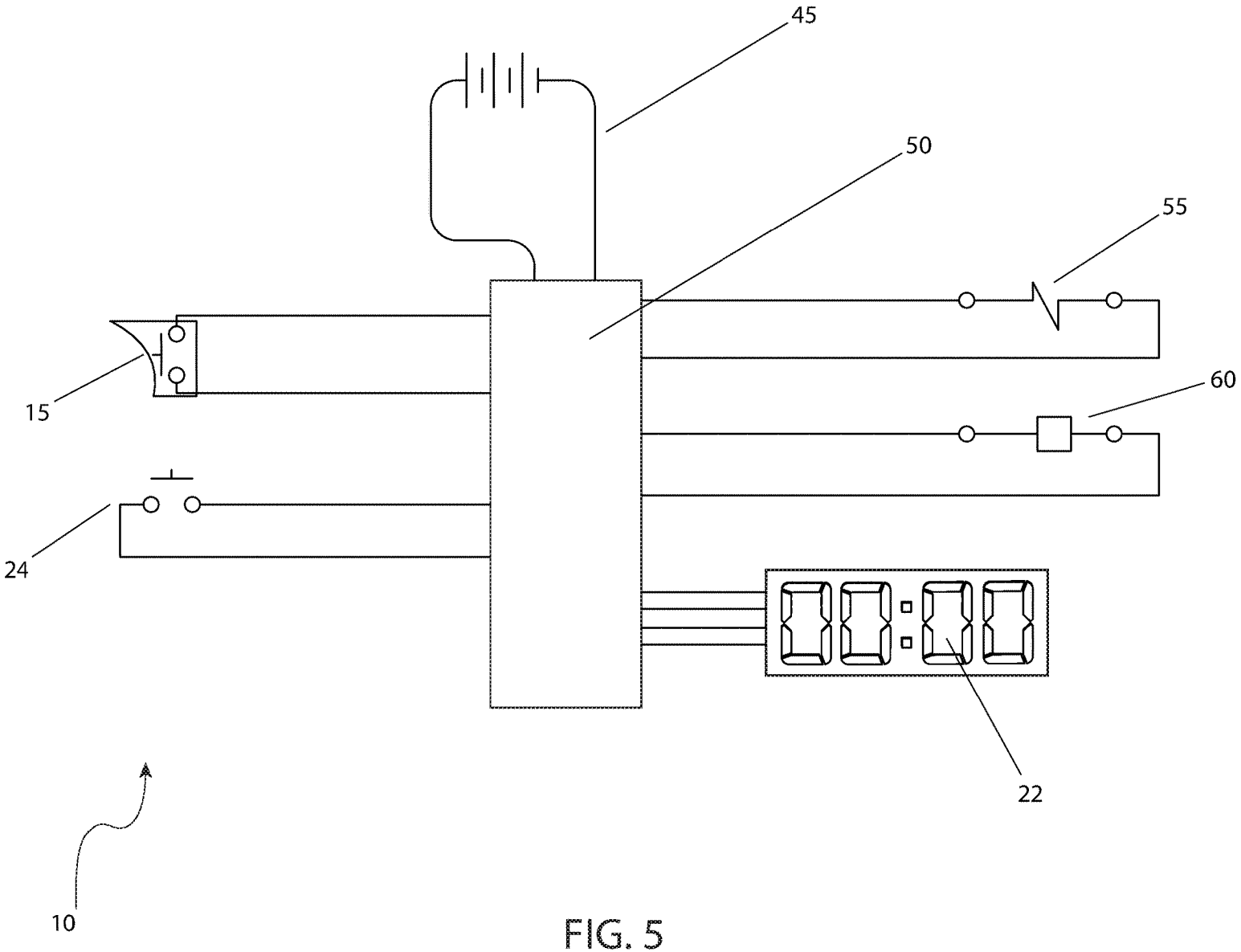

Referring to FIG. 5, an electrical block diagram of a lighter 10 incorporating a timing device, according to the preferred embodiment of the present invention is disclosed. A battery 45 provides continuous power to a main controller 50 such as an Arduino®, basic stamp module, or the like. The trigger 15 and the reset switch 24 serve as inputs to the main controller 50, while the display 22, a fuel control valve 55, and a piezo electric igniter 60 serve as outputs. When the appropriate operation sequence is desired, as aforementioned described, it is initiated by the trigger 15 which results in the main controller 50 applying power to the fuel control valve 55 and begins the stopwatch function of the display 22. A short time later, envisioned to be fractions of a second, the main controller 50 momentarily energizes the piezo electric igniter 60 to produce the flame 30 (as shown in FIG. 1). At the achievement of the desired timing cycle, as determined by the user, the trigger 15 is released. This action also deenergizes the fuel control valve 55, thus extinguishing the flame 30 and completing one operating cycle.

Other functions that are envisioned to be associated with the present invention, and fall under the scope thereof, include a re-setting of the timing device and immediate re-starting of the timing device once the reset switch 24 is activated. Another feature is an extended activation of the reset switch 24 can deactivate the display 22. A subsequent extended activation of the reset switch 24 can re-activate the display 22. Such an extended activation can be holding down the reset switch 24 for three seconds (3 sec.). A safety feature associated with the lighter 10 provides an audible alarm that is activated once the timing device reaches a pre-set limit. Such a pre-set limit can be two minutes (2 min.), a period of time associated with extensive heating of a quartz nail of a smoking device to the point of rapid degradation and spontaneous explosion thereof. Yet another feature can provide for solar-powered charging and/or activation of the power source. A protective sleeve or cover is also be envisioned. Yet another feature can be the counting down from a preferred time (on both heating and cooling cycles) that are predetermined and preprogrammed into the main controller 50, in addition to the counting up as aforementioned described.

What is claimed:

1. A lighter, consisting of:

a timing device in electrical communication with a power source and an igniter, the timing device marks when a trigger is depressed which is in mechanical communication with the igniter, the trigger is depressed resulting in commencing the timing device and actuating the igniter to produce a flame;

a display in electrical communication with the timing device and the trigger, the display provides how long it has been since the trigger has been depressed or released, depending on the current state of the trigger;

a handle enabling a user to grasp a lighter and a barrel, the barrel is an integral part of the handle and extends away from the handle at an angle;

a fuel introduced into a reservoir, the reservoir in environmental communication with the igniter;

a fill port provided to fill the reservoir with fuel;

a battery compartment cover located on a rear lower portion of the handle;

a burner assembly located inside of the barrel that is utilized with one or more fuels;

a battery provides continuous power to a main controller and, wherein an extended activation of reset switch deactivates the display;

wherein releasing the trigger resets the timing del ice and commences another timing cycle;

wherein commencing another timing cycle allows for the lighter to have both heating and cooling cycles;

wherein the trigger is located at a junction point between the handle and the barrel at an underside thereof;

wherein the timing device is a sequential counting device that counts in fractions of seconds until a reset of the timing device occurs;

wherein the timing device is the sequential counting del ice that counts in fractions of seconds until the trigger is released;

wherein the reset is achieved by a reset switch located at an upper part of the handle or the barrel and is a spring-loaded push switch;

wherein an extended activation of the reset switch deactivates the display;

wherein a subsequent depression of the trigger restarts the timing device;

wherein the sequential counting of the timing device is electrically communicated to a display;

wherein the display is mounted on the handle or the barrel adjacent to the trigger, wherein the handle has an additional grip;

wherein the barrel is hollow and provides shaping and concentration of an ignited fuel to produce the flame;

wherein the lighter is disposed on the handle and includes the flame strength adjuster;

wherein the flame strength adjuster is a dial that switches between a plurality of settings that directly correspond to a length of the flame that exits the barrel; and, wherein the lighter is a butane torch.

* * * * *